US005520552A

United States Patent [19]

Seki

[11] Patent Number: 5,520,552

[45] Date of Patent: May 28, 1996

[54] CONNECTOR INCLUDING A TERMINAL RETAINER HAVING AN EXPANDED BASE PORTION FOR ALLOWING VISUAL CONFIRMATION OF COMPLETE ENGAGEMENT

[75] Inventor: Yoshinobu Seki, Shizuoka, Japan

[73] Assignee: Yazaki Corporation, Tokyo, Japan

[21] Appl. No.: 278,867

[22] Filed: Jul. 22, 1994

[30] Foreign Application Priority Data

Jul. 22, 1993 [JP] Japan ..... 5-201313
Jul. 27, 1993 [JP] Japan ..... 5-044889 U

[51] Int. Cl.[6] ..... H01R 13/40
[52] U.S. Cl. ..... 439/595
[58] Field of Search ..... 439/595

[56] References Cited

U.S. PATENT DOCUMENTS 5,397,249 3/1995 Endo et al. ..... 439/595

*Primary Examiner*—Neil Abrams
*Assistant Examiner*—Barry Matthew L. Standig
*Attorney, Agent, or Firm*—Sughrue, Mion, Zinn, Macpeak & Seas

[57] ABSTRACT

A connector housing includes support walls provided on right and left sides of terminal receiving chambers for receiving metal terminals, respectively, these support walls having retainer-retaining projections. A retainer for being inserted into the connector housing is made of an elastic material, and has lock arms formed on a base portion in a cantilever manner. The first and second lock arms Are integrally provided with a slit formed therebetween, and the first and second lock arms are integrally provided with a slit formed therebetween. The first and second lock arms have generally the same length, and are arranged generally symmetrically with respect to a line passing through the base portion. In a completely-retained condition of the retainer, the first and second lock arms limit the movement of elastic retaining pieces engaged respectively with the metal terminals.

5 Claims, 14 Drawing Sheets

CONNECTOR INCLUDING A TERMINAL RETAINER HAVING AN EXPANDED BASE PORTION FOR ALLOWING VISUAL CONFIRMATION OF COMPLETE ENGAGEMENT

BACKGROUND OF THE INVENTION

1. Field of the Invention

This invention relates to a connector used in wiring of an automobile or the like.

2. Related Art

In a conventional connector of this type, when a metal terminal having a wire connected thereto is to be inserted into and retained on a connector housing, the metal terminal is retained by an elastic retaining piece formed on the connector housing, thereby preventing rearward withdrawal of the metal terminal. A retainer attached to the connector housing prevents an accidental movement of the elastic retaining piece, so that the metal terminal can be held stably.

Namely, the retainer engages the elastic retaining piece to limit the movement of this elastic retaining piece. There is also known a connector of the type in which projections formed on a retainer are engaged with retaining projections formed at a retainer fitting portion in such a manner that the retainer is retained provisionally and completely.

For example, a conventional retainer 104 shown in FIG. 11 includes relatively short lock arms 110*b* each having a completely-retaining projection 111*b*, and relatively long lock arms 110*a* each having an extension portion 113 and a provisionally-retaining projection 111*a*. A prevention piece 112*a* is provided between the adjacent short and long lock arms.

Another conventional example of a similar construction shown in FIGS. 12 to 14 is disclosed in Japanese Utility Model Unexamined Publication No. 4-24271.

FIG. 12 is a perspective view of a connector retainer 104 used in a conventional relay block housing, FIG. 13 is a cross-sectional view showing a condition in which the retainer 104 is provisionally retained on the housing 101, and FIG. 14 is a cross-sectional view showing a condition in which the retainer 104 is completely retained on the housing 101.

This retainer 104 includes a prevention piece 112*a* for limiting the movement of an elastic retaining piece 107*a*, and a relatively short lock arm 110*b* having a projection 111*b*, and a relatively long lock arm 110*a* having an extension portion 113 and a projection 111*a*, these lock arms serving to retain the retainer on the housing 101 provisionally and completely.

When the retainer 104 is to be provisionally retained, the projection 111*b* of the lock arm 110*b* engages an upper surface of a projection 109*b* on an inner wall 105*b* whereas the projection 111*a* of the other lock arm 110*a* engages a lower surface of a projection 109*a* on an inner wall 105*a*, thereby provisionally retaining the retainer 104, as shown in FIG. 13.

When the retainer 104 is to be completely retained, the projection 111*b* of the lock arm 110*b* engages a lower surface of the projection 109*b* of the inner wall 105*b*, thereby completely retaining the retainer 104, as shown in FIG. 14.

Here, even if the retainer 104, inverted in a right-left direction, can be attached to the housing 101, the projections 109*a* and 109*b*, as well as the projections 111*a* and 111*b*, are disposed asymmetrically, and therefore the retainer will not function properly.

In each of the above conventional constructions, the conventional retainer has the lock arms of different lengths which are used as the retaining portions for provisional and complete retaining purposes, respectively. Namely, the retainer is engaged by the lock arms separate from the elastic retaining piece for retaining a metal terminal, and the lock arms are asymmetrical right and left.

Because of this right-left asymmetrical arrangement, in a step of attaching the retainer to the connector housing particularly in the former conventional example, the retainer has often been inserted into the housing in a reverse manner, thus inviting a problem that the efficiency of the operation has been low.

Particularly in the latter conventional example, the retainer can not be of a small size because of its complicated construction, and therefore there has been encountered a problem that a mold is costly.

Furthermore, in either of the conventional examples, the prevention piece for limiting the movement of the elastic retaining piece is interposed between the lock arms through narrow slits, and therefore it has been difficult to withdraw an erroneously-attached metal terminal. Namely, for effecting such a terminal withdrawing operation, a terminal withdrawing jig is inserted into the connector housing through the slit from the retainer side after the retainer is brought into the provisionally-retained position, and then the elastic retaining piece is elastically deformed by it. However, when the jig is inserted, the prevention piece becomes obstructive, so that it has been difficult to elastically deform the elastic retaining piece. If the jig is forcibly inserted, the connector housing or other portion is gouged.

Further For example, in a connector assembly (FIG. 22 shows a perspective view of this connector) as disclosed in Japanese Utility Model Unexamined Publication No. 4-85670, elastic retaining pieces 214A and 214B are provided in a connector housing 210, and inserted metal terminals 230 are retained by the elastic retaining pieces, respectively, and then electrodes 221 of a fuse element 220 are fittingly connected to electrodes 232 of the metal terminals 230, respectively.

The metal terminal 230 is inserted into the connector housing 210 from a lower end thereof, and is moved or pushed upward, and at this time the electrode 232 contacts the elastic retaining piece 214B to elastically deform the same in a right-hand direction in the drawings, and further moves upward. Then, when the metal terminal 230 reaches a predetermined position, a projected portion of the elastic retaining piece 214B becomes engaged in a retaining hole 231 disposed beneath the electrode 232, so that the elastic retaining piece 214B is restored from its elastically-deformed condition into an initial condition.

However, even after the metal terminal 230 is retained as described above, it is possible that the elastic retaining piece 214B is elastically deformed, for example, by an impact applied during the movement of an automobile having the connector mounted thereon. In such a case, there has been a risk that the retaining of the metal terminal 230 is released, so that the metal terminal 230 is disengaged, or an imperfect contact occurs.

Therefore, there has been proposed a construction in which after a metal terminal is retained, a prevention piece, called a retainer, is inserted into a space in which an elastic retaining piece is elastically deformed, thereby preventing the elastic deformation of the elastic retaining piece after the metal terminal is properly retained. For example, Japanese Utility Model Unexamined Publication No. 3-103572 discloses a retainer of the multi-interconnecting type comprises a plurality of flat plate-like base portions 212A interconnected by connecting portions 211. FIG. 23 is a top plan view of this retainer in its attached condition, and FIG. 24 is a front-elevational view thereof.

As shown in FIG. 24, the base portion 212A has two lock arms 210*d* and 210*f* formed respectively at opposite ends thereof, and also has a prevention piece 210*e*. As shown in FIG. 23, this retainer 212 of the multi-interconnecting type is inserted into a connector housing 201 from the upper side, and is retained on the connector housing 201, so that the prevention piece 210*e* fills in a space in which an elastic retaining piece 214 is elastically deformed, thereby preventing the elastic deformation of the elastic retaining piece.

The retainer 212 is of the multi-interconnecting type, and therefore a plurality of metal terminals are arranged in a row in the connector housing 201, and are retained at a time by the single retainer 212 inserted into the connector housing, thus reducing the cost.

Namely, in this construction, one base portion 212A is associated with one pair of metal terminals. One pair of metal terminals are associated, for example, with one fuse circuit, and therefore one base portion 212A is associated with one fuse circuit.

Therefore, when a defective part needs to be exchanged as a result of checking metal terminals or wires in a fuse circuit, it is necessary to remove the wire or the metal terminal in question. However, in the case of a retainer of the multi-interconnecting type such as the above retainer 212 for retaining the metal terminals of a plurality of fuse circuits, the retaining of all of the metal terminals, associated with this retainer of the multi-interconnecting type, is released when one metal terminal is to be removed. Therefore, the operation for retaining these metal terminals again is cumbersome, and hence the maintenance is very troublesome, and is not desirable.

As described above, although the retainer is effective in retaining the metal terminals in a double manner, the retainer of the multi-interconnecting type has not been suitable from the viewpoint of maintenance.

Therefore, there has been proposed a retainer of the single interconnecting type for facilitating the removable of one metal terminal.

Furthermore, there has been developed a construction in which the retainer is retained in a two-staged manner, that is, in a provisionally-retained condition and a completely-retained condition, for enhancing the efficiency of assembling and maintenance.

The provisional retaining is to tentatively retain the retainer relative to the housing at a stage before the retainer is fully inserted into the housing, in order to enhance the efficiency of the operation such as assembling and maintenance at a factory. The provisionally-retained retainer is held in the housing, with an upper portion thereof disposed in a shallow position in the housing. The connector with the provisionally-retained retainer is shipped to the destination where metal terminal is attached, and the retainer is completely retained.

Namely, the provisionally-retained retainer is further inserted deep into a predetermined position to achieve complete retaining, and the upper portion of the thus completely-retained retainer is received deep in the housing.

In such a construction, during the assembling operation in which the complete retaining is to be effected after the metal terminals are attached, or at the time of effecting an inspection with only the metal terminals removed, the associated retainer is disposed in a shallow position whereas its adjoining retainer is disposed deep.

In the conventional retainer, its upper portion is in the form of a flat plate, and therefore there has been encountered a disadvantage that it is not clear as to whether the retainer to be noted during the operation is disposed shallow or deep.

Therefore, even if the provisionally-retained retainer fails to be shifted or brought into the completely-retained position after the assembling operation or the checking operation, this is often overlooked, and the connector with the provisionally-retained retainer is used, which results in a problem that the metal terminal is disengaged as described above.

SUMMARY OF THE INVENTION

With the above problems in view, it is an object of this invention to provide a connector having a retainer which will not be erroneously inserted when it is to be attached, and is simple in construction and small in size, and makes it possible to reduce the cost of its mold, and allows a terminal to be easily withdrawn.

An object of this invention is to provide a connector in which a provisionally-retained condition or a completely-retained condition of a retainer can be easily confirmed.

The above object of the present invention has been achieved by a connector comprising, in combination, a connector housing in which metal terminals are retained respectively by elastic retaining pieces provided respectively in a plurality of terminal receiving chambers for receiving the inserted metal terminals, respectively, and retaining projections for retaining an inserted retainer provisionally and completely are formed respectively on support walls provided respectively on right and left sides of the adjacent terminal receiving chambers; and the retainer includes lock arms which have respective projections, and are formed on a base portion in a cantilever manner; wherein the retainer has the first and second lock arms of generally the same length which are disposed generally symmetrically, and are integrally connected together, with a slit formed therebetween; and the first and second lock arms, when completely retained on the connector housing, are engaged with the elastic retaining pieces.

The above object has been achieved by a connector wherein a connector housing has elastic retaining pieces which are spaced by a gap, and are provided adjacent to terminal receiving chambers so as to retain metal terminals, respectively; the housing has retainer-retaining protuberances provided adjacent to the terminal receiving chambers; a retainer for being inserted into the connector housing is retained provisionally and completely by the protuberances when the retainer is inserted into the housing; and in a completely-retained condition, a lock arm, formed in a cantilever manner on a base portion of the retainer, is received in the gap to prevent the elastic retaining pieces from being deformed, wherein an expanding portion is formed integrally on an upper surface of the base portion of the retainer at at least one of opposite longitudinal ends of the base portion, the expanding portion being larger in cross-sectional area than the base portion.

The first and second lock arms of the retainer are disposed generally symmetrically, and therefore even if the retainer is turned over right and left, and is attached to the connector housing, the normal function can be achieved without any problem. Moreover, when the first and second lock arms are to be completely retained, they are elastically deformed in a manner to narrow the slit, and the first and second lock arms are engaged with the elastic retaining pieces to limit the movement of these retaining pieces. Therefore, the prevention piece as used in the conventional construction can be omitted, so that a small-size design can be achieved. Because of omission of such a prevention piece, a terminal withdrawing jig, inserted into the connector housing through the slit, can be easily operated to elastically deform the elastic retaining piece, thereby facilitating the withdrawal of the terminal.

When the retainers are attached to the connector housing, those retainer in the provisionally-retained condition are held in a shallow position in the connector housing, whereas those retainers in the completely-retained condition are held in a deep position in the connector housing. Therefore, if the retained condition of part of the retainers arranged in a row is different from that of the other retainers, the position of the expanding portion (which is formed on the upper surface of the retainer at at least one longitudinal ends thereof, and is larger in cross-sectional area than the base portion) of the former retainers is different from that of the expanding portions of the latter retainers. Therefore, the expanding portions of those retainers provisionally retained in the shallow position can be easily confirmed, or the difference in height between the top surfaces can be easily confirmed, so that it is confirmed that part of the retainers are still in the provisionally-retained condition and that the metal terminals are incompletely retained.

BRIEF DESCRIPTION OF THE DRAWINGS

FIG. 2(*b*) is a front-elevational view thereof;

FIG. 2(*c*) is a side-elevational view thereof;

FIG. 3(*b*) is a similar view showing a condition in which the retainer shifts into a completely-retained position;

FIG. 3(*c*) is a similar view showing the completely-retained condition;

FIG. 17(*b*) showing the process of retaining metal terminals;

FIG. 17(*c*) showing a completely-retained condition;

FIG. 17(*d*) showing a condition in which a fuse element is attached;

DETAILED DESCRIPTION OF THE PREFERRED EMBODIMENTS

A preferred embodiment of the present invention will now be described with reference to the drawings.

First Embodiment

In this embodiment, a connector of the present invention is applied to a fuse box in which one fuse circuit is formed by a pair of metal terminals.

Reference is first made to the construction of an embodiment of the present invention. For illustration purposes, an X-axis represents a right-left direction, Y-axis represents forward-backward direction, and a Z-axis represents an upward-downward direction.

Figure 1:
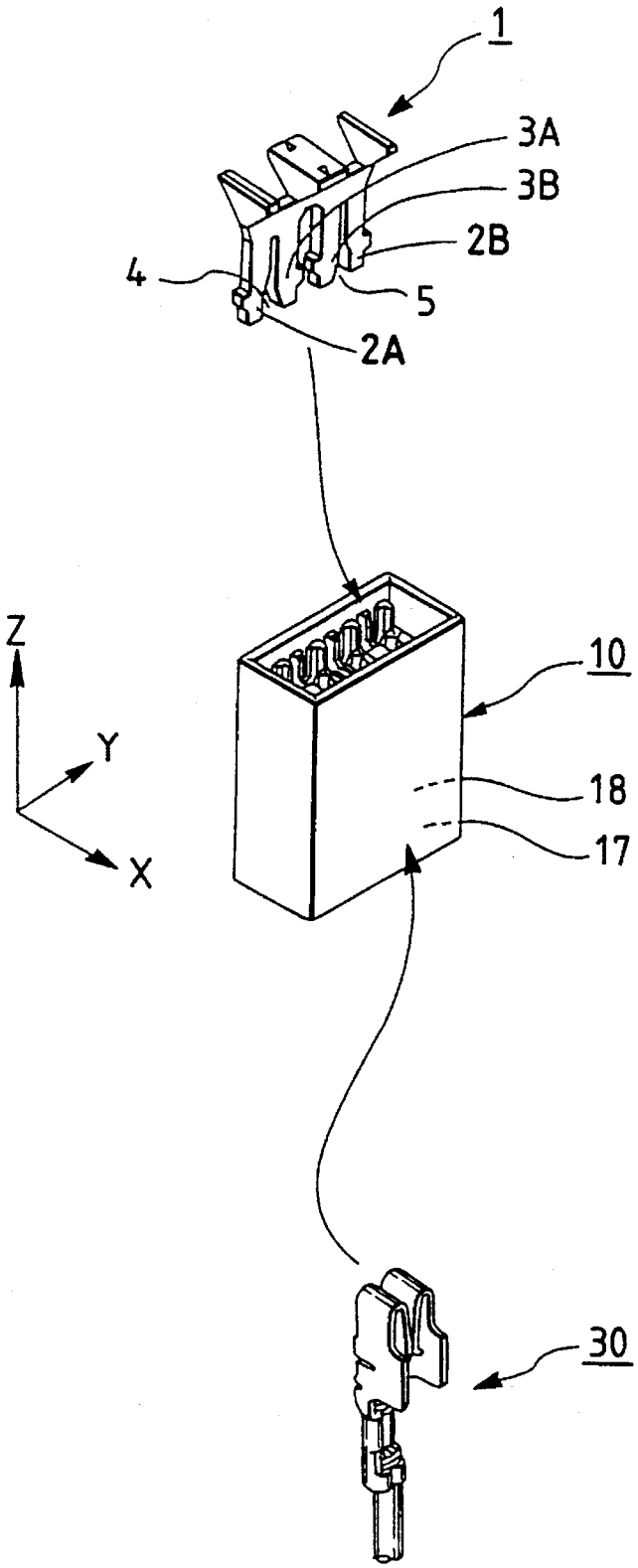
FIG. 1 is a perspective view of one preferred embodiment of a retainer of the invention for a connector.
Figure 2A:
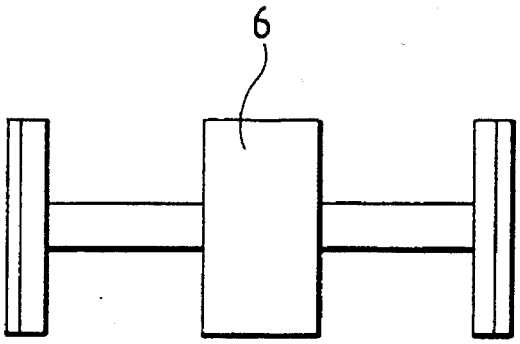
FIG. 2(*a*) is a top plan view of the retainer of FIG. 1.
Figure 2B:
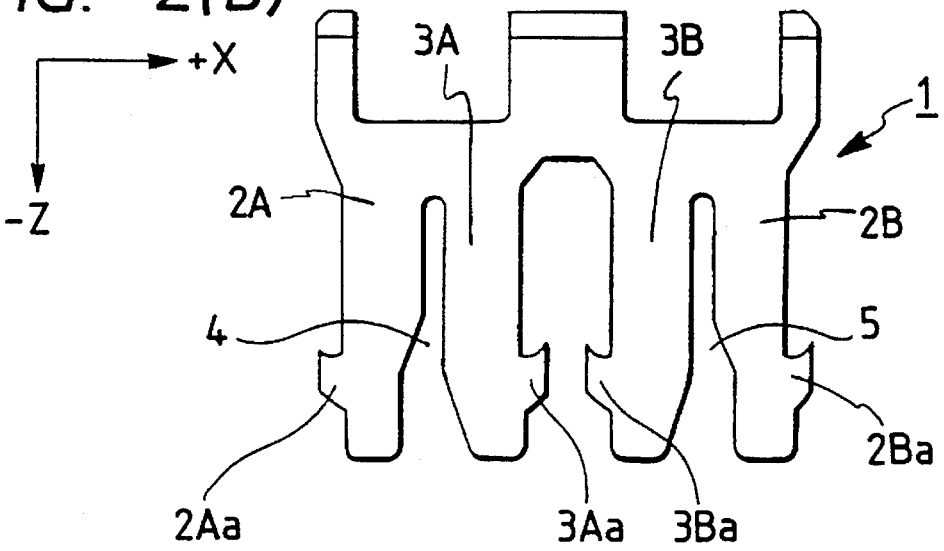
Figure 2C:
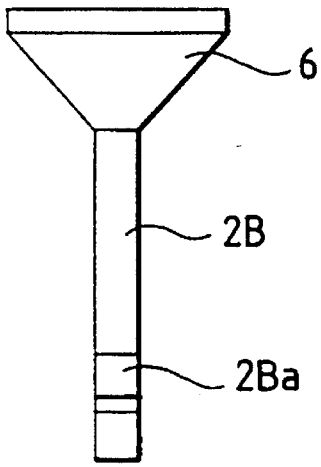

A retainer 1 is made of an elastic synthetic resin, and as shown in FIG. 2, two pairs of first and second lock arms 2A, 2B, 3A and 3B are formed on right and left ends of a base portion 6 in a cantilever manner, and oppositely-directed first and second projection 2A*a*(2B*a*) and 3A*a*(3B*a*) are formed on each pair of first and second lock arms, respectively. A slit 4 is formed between the first lock arm 2A and the second lock arm 3A, and a slit 5 is formed between the first lock arm 2*b* and the second lock arm 3B. These slits 4 and 5 themselves do not always need to be symmetrical right and left in configuration, but the two pairs of first and second lock arms (between each of which pairs the slit 4, 5 is formed) are disposed generally or accurately symmetrical right and left.

Particularly in this embodiment, in order that the amount of alternate elastic deformation of the first and second lock arms toward the slit when the retainer 1 shifts from its provisionally-retained to completely-retained position and vice verse as later described in detail can be made as large as possible even if the width of the slit 4, 5 is small as a result of a small-size design of the retainer 1, an open end portion of the slit is enlarged.

A connector housing 10 comprises a box-like body made of an electrically-insulative synthetic resin, and has a pair of terminal receiving chambers 17 and 18 each for receiving a metal terminal 30 inserted thereinto from the lower side.

The metal terminal 30 is received in the pair of front and rear terminal receiving chambers 17 and 18, thereby forming one circuit. In actual use, a plurality of pairs of front and rear terminal receiving chambers 17 and 18 are usually provided in a row in the right-left direction.

Figure 7:
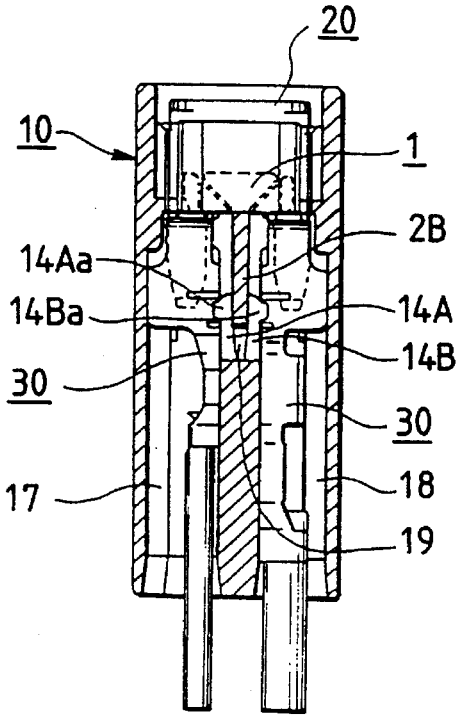
FIG. 7 is a side-elevational, cross-sectional view of the connector housing having the fuse elements attached thereto in the completely-retained condition of the retainer of the invention.
Figure 8:
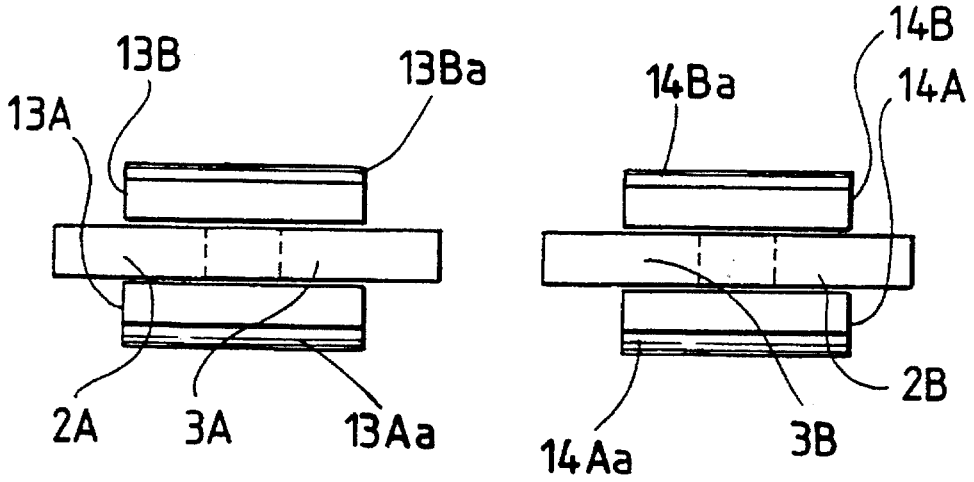
FIG. 8 is a view explanatory of a condition in which lock arms of the retainer of the invention are received in a gap between a pair of elastic retaining pieces.
Figure 9:
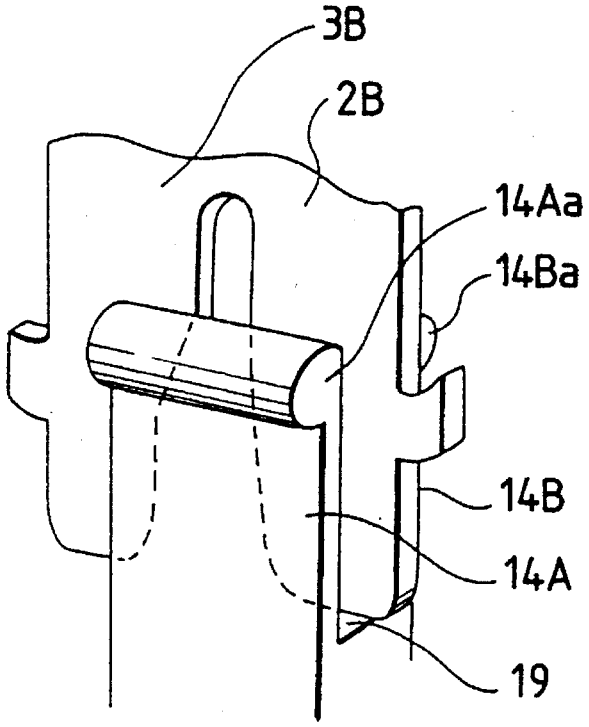
FIG. 9 is a perspective view of an important portion showing the condition in which the lock arms of the retainer of the invention are received in the gap between the pair of elastic retaining pieces.

A pair of elastic retaining pieces 14A and 14B are provided between the pair of front and rear terminal receiving chambers 17 and 18, and are spaced from each other by a gap 19. These retaining pieces 14A and 14B have metal terminal retaining projections 14A*a* and 14B*a* (see FIG. 7), respectively, and the pair of metal terminals 30 and 30 are retained by these metal terminal retaining projections 14A*a* and 14B*a*, respectively (FIGS. 8 and 9).

First projections 11A*a* and 11B*a* for provisionally retaining the inserted retainer 1 are formed respectively on first support walls 11A and 11B, and second projections 12*a* and 12*b* for completely retaining the inserted retainer 1 are formed on a second support wall 12. These support walls 11A, 11B and 12 are arranged in a direction (right-left direction) perpendicular to the direction (forward-backward direction) of arrangement of the terminal receiving chambers 17 and 18.

Next, the operation of the retainer will now be described.

Figure 4:
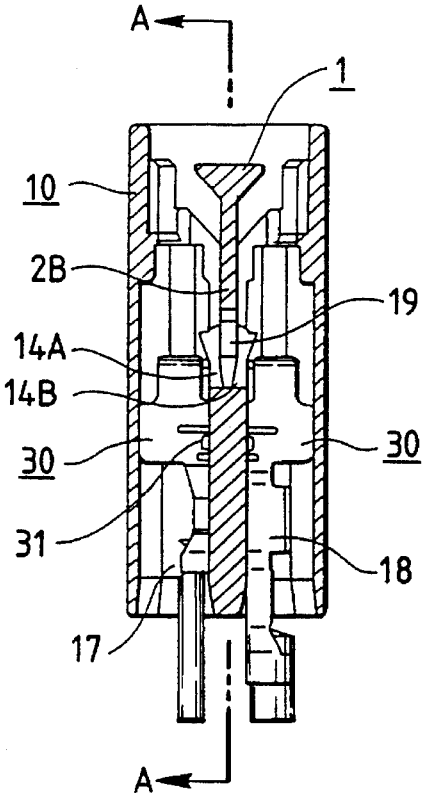
FIG. 4 is a side-elevational, cross-sectional view of the connector housing having the retainer provisionally retained thereon, with metal terminals not yet retained.

In FIG. 4, the retainer 1 is held in a provisionally-retained condition within the connector housing 10.

The pair of metal terminals 30 and 30 are being inserted upwardly respectively into the terminal receiving chambers 17 and 18 from the lower side.

Figure 3A:
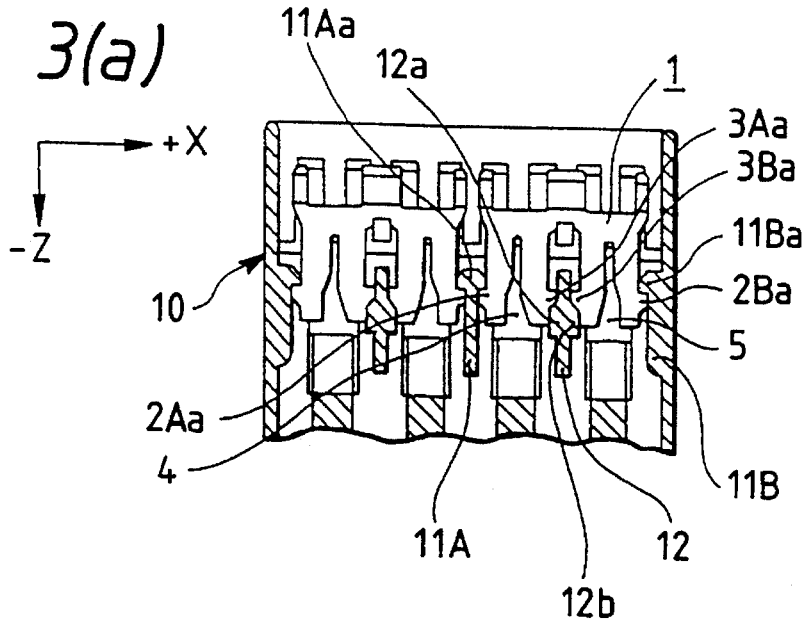
FIG. 3(*a*) is a front-elevational, cross-sectional view of a connector housing having the retainer of FIGS. 2(*a*) to (*c*) provisionally retained thereon.
Figure 3B:
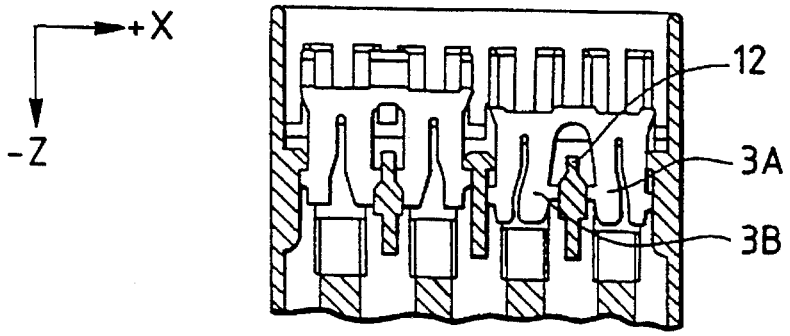
Figure 3C:
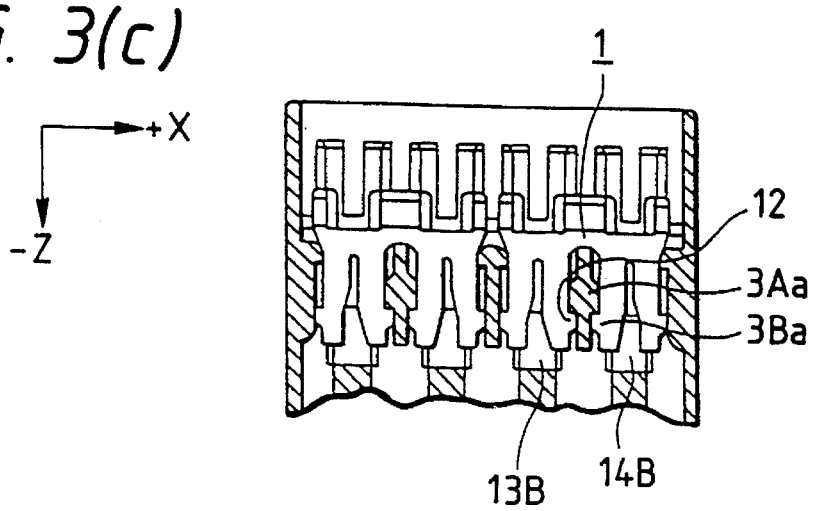

As shown in FIG. 3(*a*), in the provisionally-retained position of the retainer 1, the first projections 2A*a* and 2B*a* of the first lock arms 2A and 2B are engaged respectively with the lower side of the first projection 11A*a* of the first support wall 11A and the lower side of the first projection 11B*a* of the first support wall 11B, whereas the second projections 3A*a* and 3B*a* of the second lock arms 3A and 3B are engaged respectively with the upper sides of the second projections 12*a* and 12*b* of the second support wall 12.

As is clear from this Figure, the support walls as well as the projections thereof are symmetrical right and left, and therefore even if the retainer 1 is turned over with respect to its front and back sides, and is inserted in this condition, any disadvantage will not occur, and the same effect as described above can be achieved.

Figure 5:
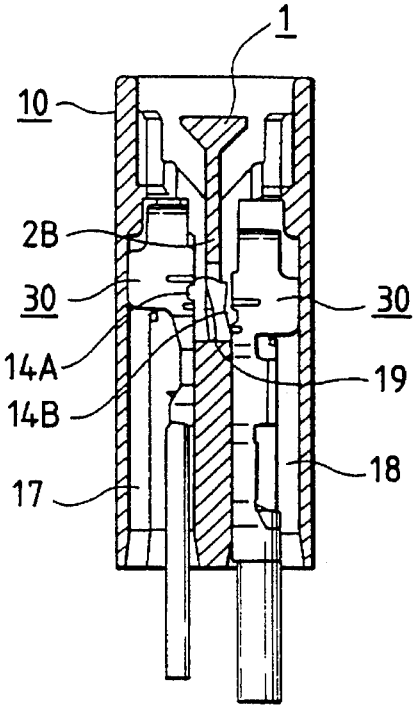
FIG. 5 is a side-elevational, cross-sectional view of the connector housing having the retainer provisionally retained thereon, showing the process of retaining the metal terminals.

Then, as shown in FIG. 5, the metal terminals 30 and 30 are inserted deep respectively into the terminal receiving chambers 17 and 18, and are retained there, with the retainer 1 kept in the provisionally-retained position. In this Figure, the retaining of the metal terminal 30 in the terminal receiving chamber 17 is completed, and the elastic retaining piece 14A is engaged in a retaining hole 31 (see FIG. 4) to retain this metal terminal.

The metal terminal 30 in the terminal receiving chamber 18 is in the process of the retaining operation, and a front end portion of this metal terminal 30 is moving upward while forcing the elastic retaining piece 14B toward the gap 19.

FIG. 3(*b*) shows a condition in which the retainer 1 is shifted from the provisionally-retained condition to the completely-retained condition after the metal terminals 30 and 30 are inserted deep into the terminal receiving chambers 17 and 18, respectively. The retainer 1 is gradually pressed down, and the second projections 3A*a* and 3B*a* of the second lock arms 3A and 3B slide over the second projections 12*a* and 12*b* of the second support wall 12, respectively, so that the retainer 1 is deformed. This deformation proceeds in such a manner as to narrow the slits 4 and 5, and therefore there is obtained a feature that the elastic deformation of a greater degree can be obtained than before.

As is clear from the drawings, the support walls as well as the projections thereof are symmetrical right and left, and therefore even if the retainer 1 is turned over with respect to its front and back sides, and is inserted in this condition, any disadvantage will not occur, and the same effect as described above can be achieved.

When this shifting operation is finished, so that the second projections 3A*a* and 3B*a* of the second lock arms 3A and 3B pass over the second projections 12*a* and 12*b* of the second support wall 13, respectively, the retained is completely retained as shown in FIGS. 3(*c*) and 7.

As is clear from the drawings, the support walls as well as the projections thereof are symmetrical right and left, and therefore even if the retainer 1 is turned over with respect to its front and back sides, and is inserted in this condition, any disadvantage will not occur, and the same effect as described above can be achieved.

In the completely-retained condition, the second lock arms 3A and 3B of the retainer 1 are elastically restored, and the first and second lock arms 2A and 3A are received in the gap 19 between the elastic retaining pieces 13A and 13B, and the first and second rock arms 2B and 3B are received in the gap 19 between the elastic retaining pieces 14A and 14B, as shown in FIGS. 8 and 9, As a result, for example, the elastic retaining pieces 14A and 14B are prevented by the lock arms 2B and 3B from being elastically deformed toward the gap 19, thereby stably retaining the metal terminals 30.

Namely, in the completely-retained condition, for example, the lock arms 2B and 3B serve as a stopper means for preventing the movement of the elastic retaining pieces 14A and 14B.

Figure 6:
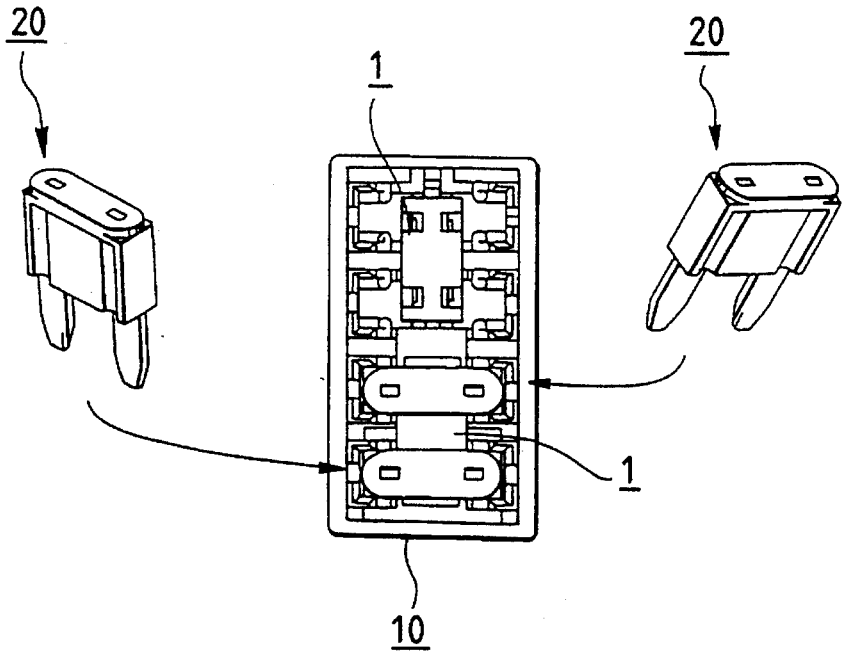
FIG. 6 is a top plan view showing the manner of attaching fuse elements to the connector housing.

In this condition, a fuse element 20 is attached to the connector housing 10, and terminals of this fuse element engage the metal terminals 30 and 30, respectively, thus making an electrical connection, as shown in FIG. 6.

In the construction shown in FIG. 3, the first projections of the first lock arms are retainingly engaged with the first projections of the first support walls, respectively, while the second projections of the second lock arms are retainingly engaged with the second projections of the second support wall, respectively.

Figure 10A:
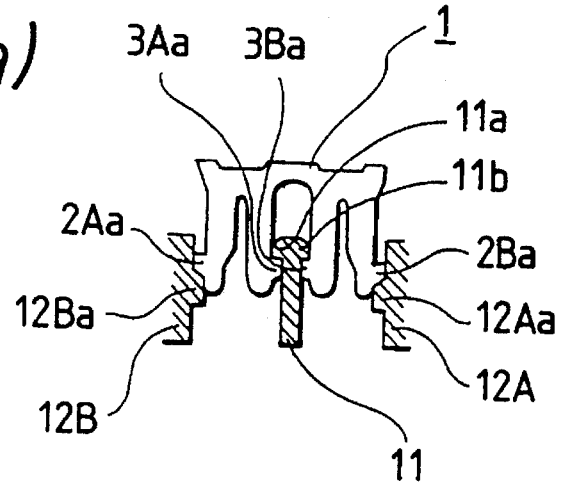
FIGS. 10(*a*) and (*b*) front-elevational views showing a condition in which a retainer of the invention is attached to a housing having support walls of a different design.
Figure 10B:
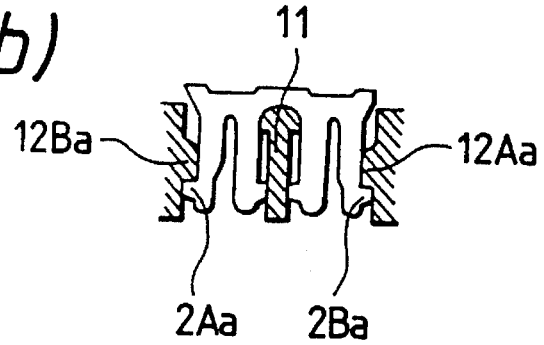
Figure 11:
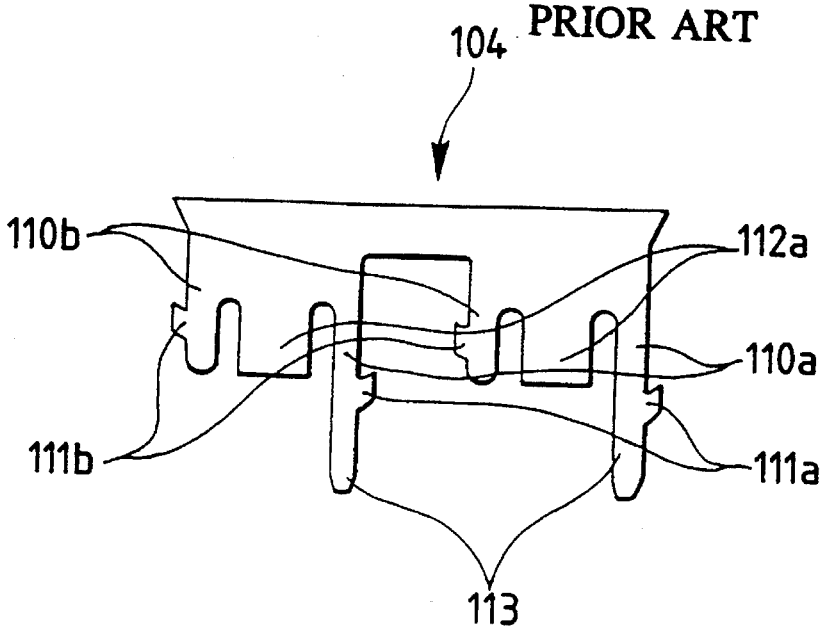
FIG. 11 PRIOR ART
FIG. 11 is a front-elevational view of a conventional asymmetrical retainer.
Figure 12:
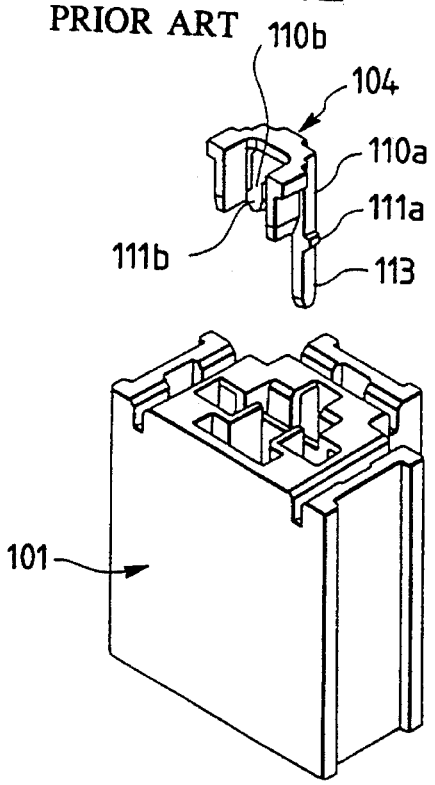
FIG. 12 PRIOR ART
FIG. 12 is a perspective view showing a conventional asymmetrical retainer and a housing.
Figure 13:
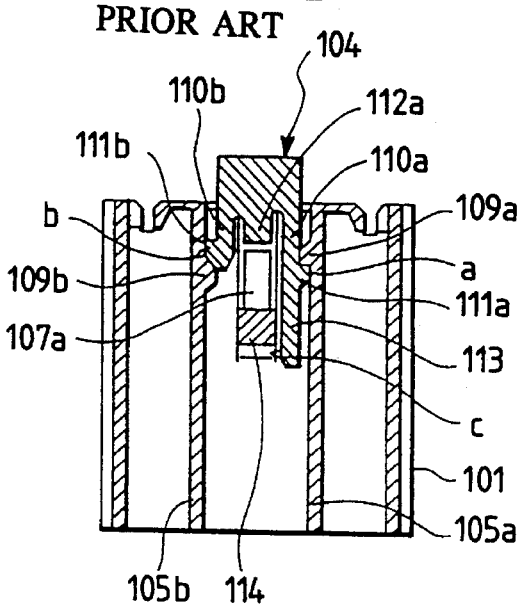
FIG. 13 PRIOR ART
FIG. 13 is a cross-sectional view showing the conventional asymmetrical retainer in its provisionally-retained condition.
Figure 14:
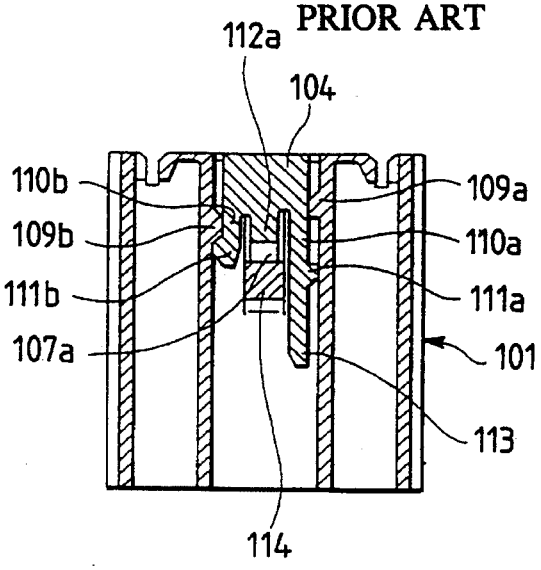
FIG. 14 PRIOR ART
FIG. 14 is a cross-sectional view showing the conventional asymmetrical retainer in its completely-retained condition.

The positions of such first and second support walls can be reversed as shown in FIG. 10, in which case the first projections 2A*a* and 2B*a* are retainingly engaged with second projections 12B*a* and 12A*a*, respectively, whereas the second projections 3A*a* and 3B*a* are retainingly engaged with first projections 11*a* and 11*b*, respectively.

As described above, in the connector of the present invention, even if the retainer 1 is attached to the connector housing 10 in either of the opposite directions, the intended function of the retainer can be obtained. Therefore, any particular care is not needed in the assembling process, and an erroneous assembling due to a reverse attachment of the retainer as previously experienced can be completely eliminated.

Moreover, there is no need to provide an erroneous connection prevention means on the connector housing or the retainer, and the cost can be reduced also from this aspect.

With the construction of the retainer of the present invention, the first lock arms 2A and the second lock arms 3A are not long, and when the retainer 1 is to be withdrawn from the completely-retained position to the provisionally-retained position, or when the metal terminal 30 is to be withdrawn from the connector housing 10, a terminal withdrawing jig can be inserted through the slit 4, 5, and can be operated easily. Therefore, there is obtained an advantage that the elastic retaining piece can be elastically deformed to be disengaged from the terminal, so that the withdrawal of the terminal can be carried out quite easily.

Each pair of first and second lock arms can perform the function of the conventional prevention piece, and therefore the connector can be simplified in construction and be of a small size, and the cost of the material as well as the cost of a mold can be reduced. This makes it possible to provide the connector at low costs, Particularly, the conventional prevention piece is isolated by the right and left slits, and therefore for example, when the metal terminal is forcibly inserted, with the surface of the plate of the prevention piece held against the elastic retaining piece to prevent the movement of the prevention piece, so that this elastic retaining piece is deformed, the prevention piece can often elastically deformed or warped, following the deformation of the elastic retaining piece.

In contrast with this, in the retainer for the connector of the present invention, the lock arms, performing the function of the conventional prevention piece, are engaged at their projections with the support walls, and hence are prevented from being warped, and therefore the situation as encountered with the above conventional construction will not occur, and the movement of the elastic retaining piece can be suppressed more positively.

In the above embodiment, although the present invention is applied to the fuse box, the invention can be applied to the type of connector for connecting ordinary wires, in which a plurality of terminal receiving chambers are arranged in a row in a right-left direction as in a half of the above fuse box obtained by dividing it in the forward-backward direction. However, with respect to the type in which a retainer is separate from a connector housing, a fuse box as described in the above embodiment iS usually used.

In the above embodiment, although the retainer is of the double interconnecting type having two pairs of lock arms, the invention is not limited to this construction, and can be applied to a single interconnecting type or an interconnecting type as having more than two pairs of lock arms.

Second embodiment

Figure 15:
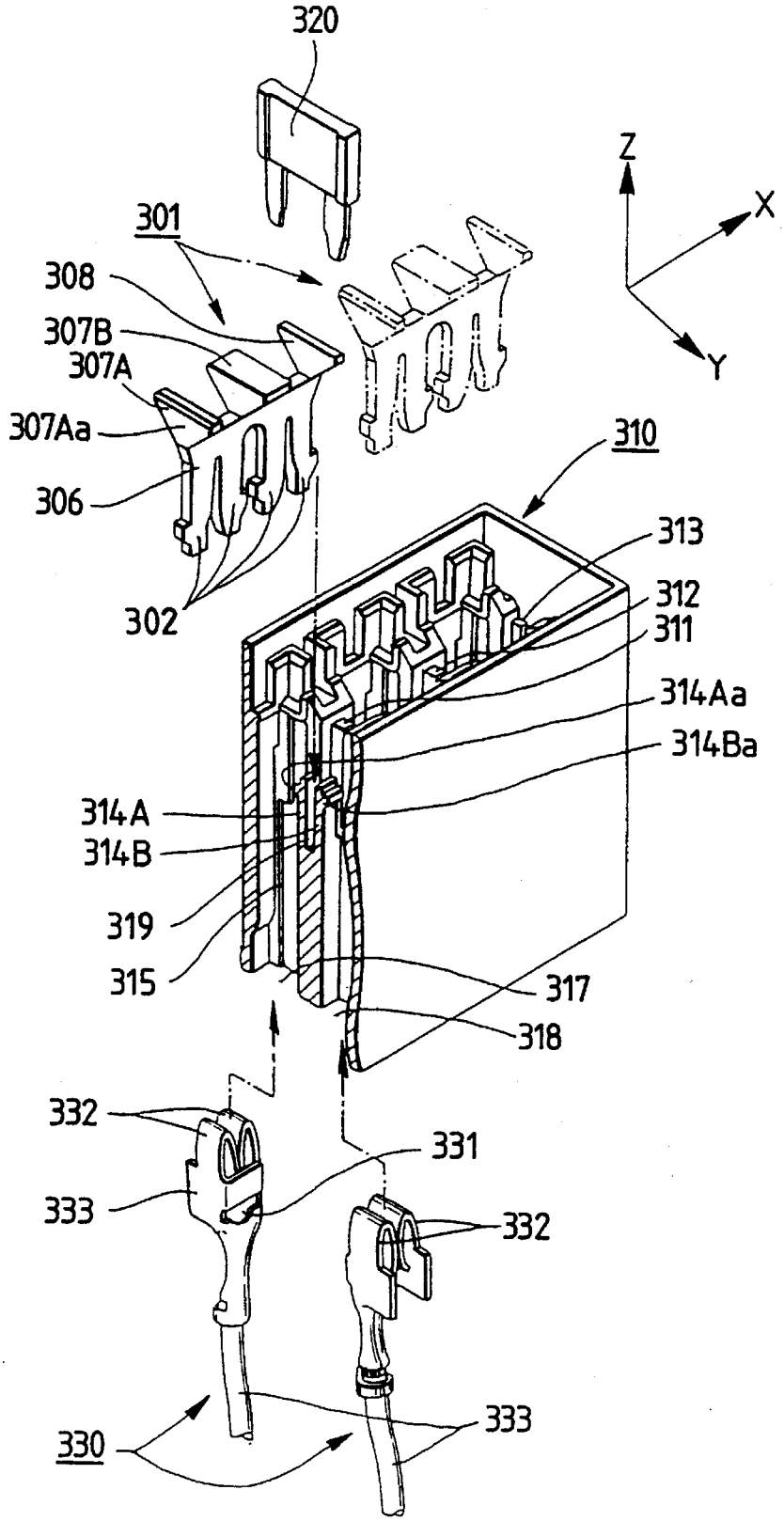
FIG. 15 is a perspective view of a second embodiment of the invention, showing a retainer for a connector of the invention, as well as a connector housing for receiving this retainer.
Figure 16:
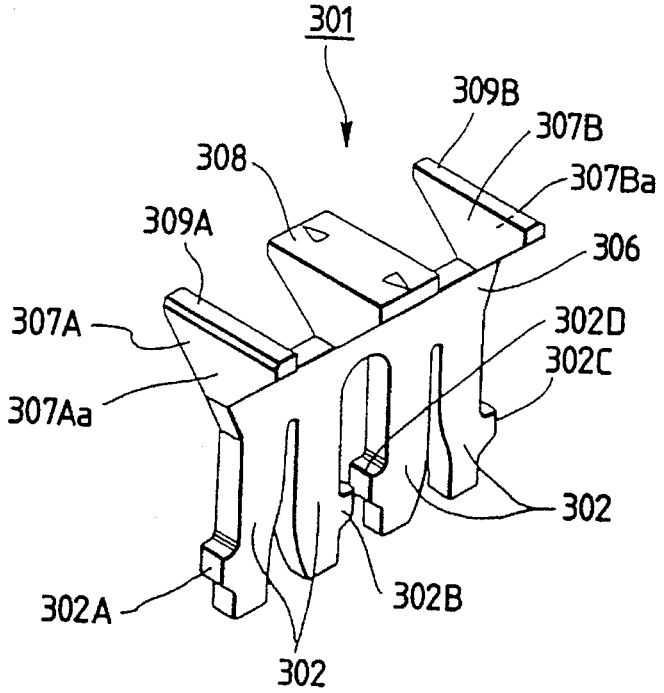
FIG. 16 is a perspective view of the connector retainer of FIG. 17.

A second embodiment of the present invention will now be described with reference to FIGS. 15 and 16. In the drawings, for illustration purposes, an X-axis represents a right-left direction, a Y-axis represents forward-backward direction, and a Z-axis represents an upward-downward direction.

The retainer 301 is made of an elastic synthetic resin, and includes two pairs of lock arms 302 formed respectively on opposite (right and left) end portions of a base portion 6 in a cantilever manner. Outwardly-directed projections 302A, 302B, 302C and 302D are formed on the four lock arms 302, respectively.

An expanding portion 307A, 307B, larger in cross-sectional area than the base portion 306, is formed integrally on the upper surface of the base portion 306 at at least one of opposite longitudinal ends of the base portion 306. In other words, the expanding portion 307A, 307B is larger in width than the base portion 306.

The cross-sectional shape of the expanding portion 307A, 307B is an inverted triangular shape in the drawings, but this is merely one example, and any other suitable shape may be used.

Preferably, two expanding portions 307A and 307B are provided, but even if one of them is used, this is acceptable. A flat top surface 309 may be provided on the upper end. Further, a reinforcement portion 308 may be formed between the expanding portions 307A and 307B for reinforcing purposes.

The construction of the connector housing to which the above retainer 301 for the connector is attached will now be described with reference to FIG. 15.

The connector housing 310 is in the form of a box made of an electrically-insulative synthetic resin, and has a pair of terminal receiving chambers 317 and 318 for respectively receiving metal terminals 330 inserted from a lower end of the connector housing.

One metal terminal 330 is received in each of the pair of front and rear terminal receiving chambers 317 and 318. In actual use, a plurality of pairs of terminal receiving chambers are usually provided in a row in the right-left direction.

A pair of elastic retaining pieces 314A and 314B are provided between the pair of front and rear terminal receiving chambers 317 and 318, and are spaced from each other by a gap 319. These retaining pieces 314A and 314B have metal terminal retaining projections 314A*a* and 314B*a*, respectively, which are fitted respectively in retaining holes 331, formed respectively in the metal terminals 330, thereby retaining the metal terminals.

Protuberances described hereinbelow are formed on support walls 311, 312 and 313 arranged in the right-left direction, that is, the direction of arrangement of the pairs of terminal receiving chambers. These protuberances are engaged with the projections 302A, 302B, 302C and 302D of the inserted retainer 301, thereby retaining the retainer 301 in a provisionally-retained position and a competently-retained position.

Next, the operation of the retainer for the connector of the invention will now be described.

In FIG. 17(*a*), the retainer 1 is disposed in the provisionally-retained condition in the connector housing 310. At this time, the metal terminals have not yet been inserted, and the connector in this condition is shipped from a factory.

Figure 20:
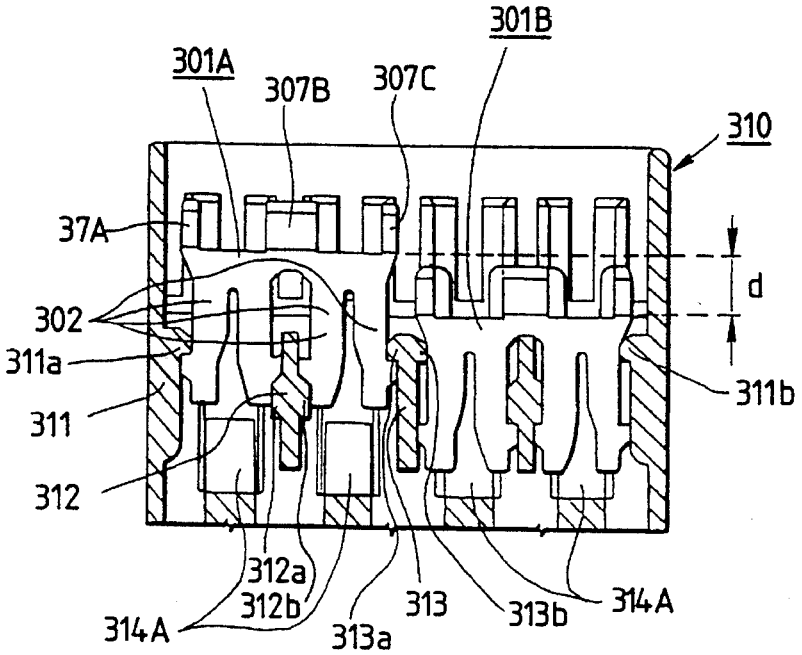
FIG. 20 is front cross-sectional view showing a condition in which the retainers of the invention are in their respective provisionally-retained and completely-retained positions in the connector housing.

As shown in FIG. 20, in the provisionally-retained condition of the retainer 301A, the projections of its lock arms 302 are engaged with the protuberances 311*a*, 311*b*, 312*a*, 312*b*, 313*a* and 313*b* of the support walls 311, 312 and 313, respectively.

The distal ends of the lock arms 302 are disposed above the elastic retaining pieces 314A.

In this condition, the connector assembling operation is started. As shown in FIG. 17(*b*), in the provisionally-retained condition of the retainer 301, the pair of metal terminals 330 and 330 are inserted deep into the terminal receiving chambers, respectively, and are retained there. The pair of metal terminals 330 are inserted upwardly along guide grooves 315 and 315 from the lower ends of the terminal receiving chambers 317 and 317.

In FIG. 17(*b*), the retaining of the metal terminal 330 in the terminal receiving chamber 317 has been completed, and the retaining hole is retainingly fitted on the metal terminal retaining projection 314A*a* of the elastic retaining piece 314A.

The metal terminal 330 in the terminal receiving chamber 318 is in the process of retaining, and is moving upward in such a manner that an electrode 332 of the metal terminal forces the elastic retaining piece 314B toward the gap 319.

FIG. 17(*c*) shows a condition in which the retainer 301 shifts from the provisionally-retained position to the completely-retained position after the metal terminals 330 and 330 are inserted deep respectively into the terminal receiving chambers 317 and 318, and are completely retained.

In the completely-retained condition, the lowered lock arms 302 are received in the corresponding gaps 319, and serve to prevent the elastic deformation of the elastic retaining pieces 314A as in the retainer 301B in FIG. 20. As a result, the lock arms prevent the elastic retaining pieces 14A from being elastically deformed toward the gap 319, thus retaining the metal terminals 330 in a stable manner.

Thereafter, the fuse element 320 is attached as shown in FIG. 17(*d*), thereby completing the assembling operation.

Figure 19:
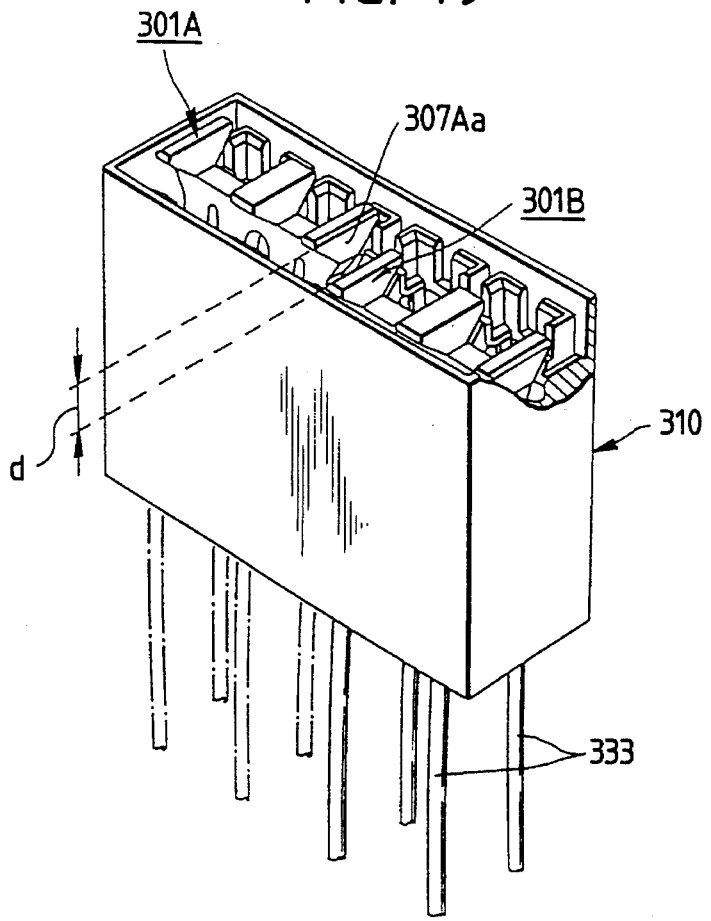
FIG. 19 is a perspective view showing a condition in which the retainers of the invention are in their respective provisionally-retained and completely-retained positions in the connector housing.

As is clear from FIG. 20, the provisionally-retained retainer is raised a distance d from the completely-retained retainer. This condition will now be explained with reference to FIG. 19 (which is a perspective view showing the condition corresponding to that shown in FIG. 20).

In the connector housing 310, the provisionally-retained retainer 301A is raised a distance d from the completely-retained, adjoining retainer 301B. Therefore, for example, a side surface 307A*a* of the expanding portion 307A of the raised retainer 301A in its provisionally-retained condition can be easily confirmed with the eyes.

In the case where the flat top surface 309A, 309B is formed on the expanding portion, it can be easily confirmed from the difference in height from the top surface of the adjoining retainer that the retainer 301A is in its provisionally-retained condition, and also an incomplete retaining condition of the metal terminal can be easily detected.

Figure 18:
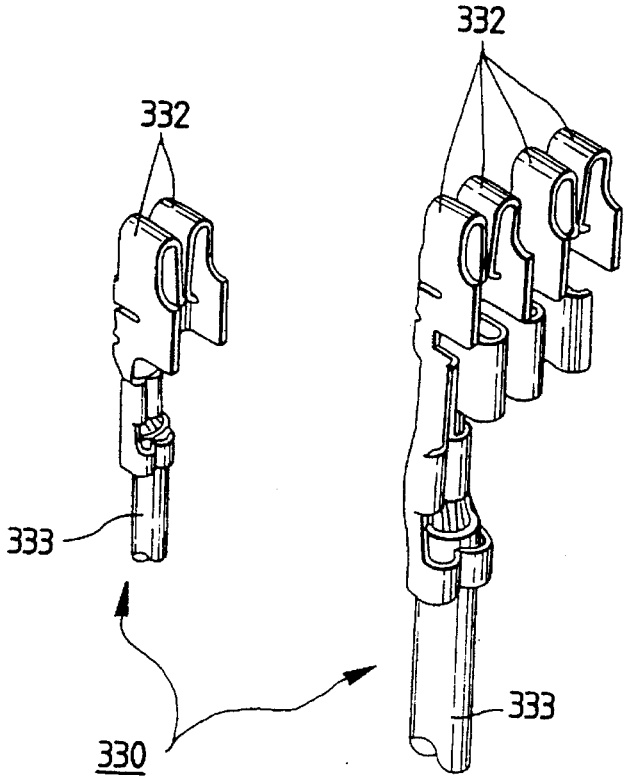
FIG. 18 is a perspective view of metal terminals to be inserted in the connector housing.
Figure 17A:
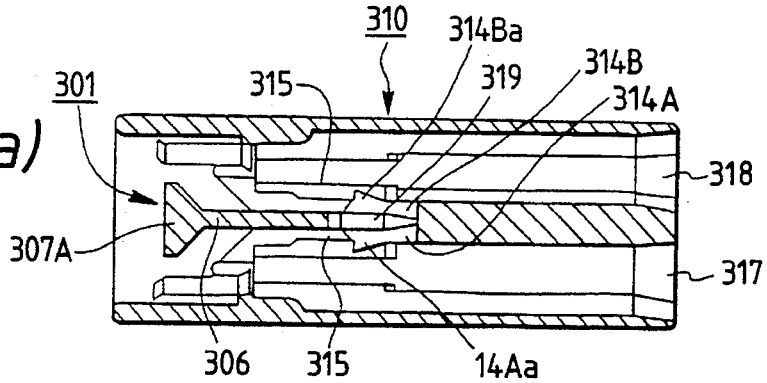
FIG. 17(*a*) showing a side cross-sectional view of provisionally-retained condition in the retainer of FIG. 16 on the fuse connector housing.
Figure 17B:
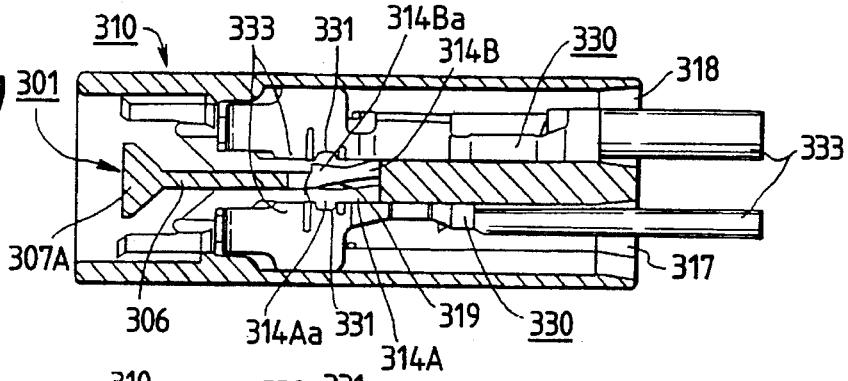
Figure 17C:
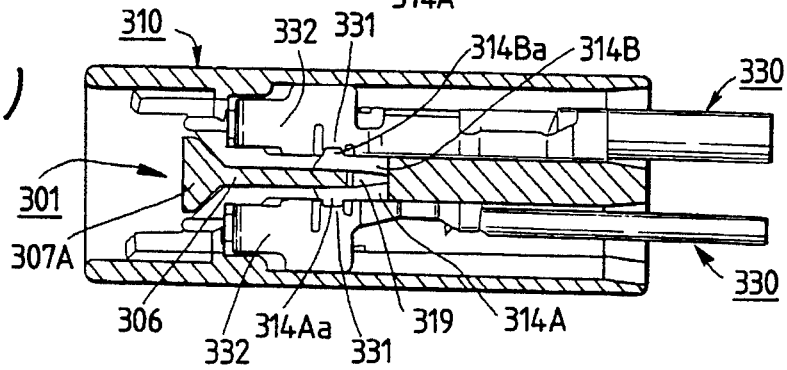
Figure 17D:
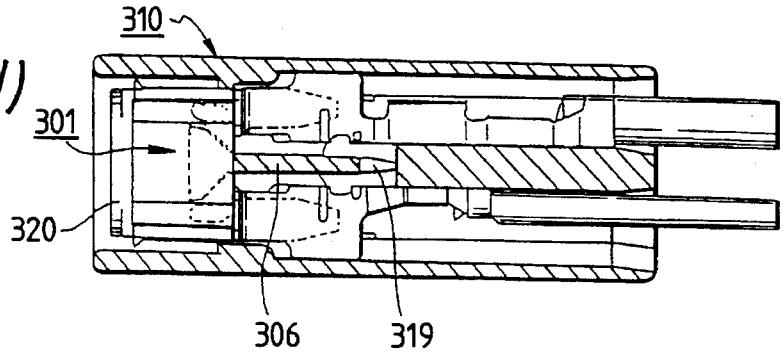

FIG. 18 is a perspective view of the metal terminal to be attached to the connector housing.

As shown in this Figure, the metal terminal 330 may have either a single electrode 332 or a plurality of electrodes 332.

Figure 21:
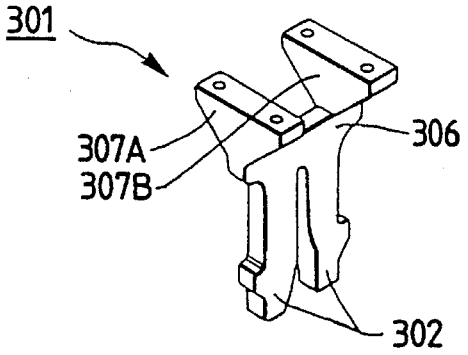
FIG. 21 is a perspective view of another embodiment of a retainer of the present invention.
Figure 23:
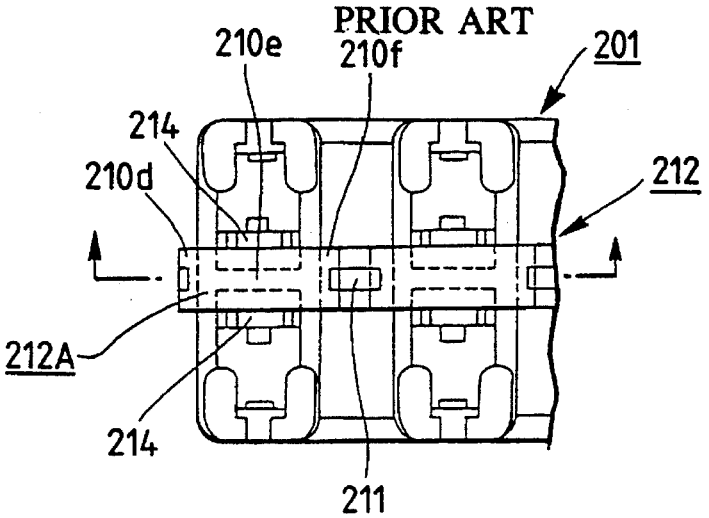
FIG. 23 PRIOR ART
FIG. 23 is a top plan view showing a conventional retainer of the multi-interconnecting type attached to a housing.
Figure 24:
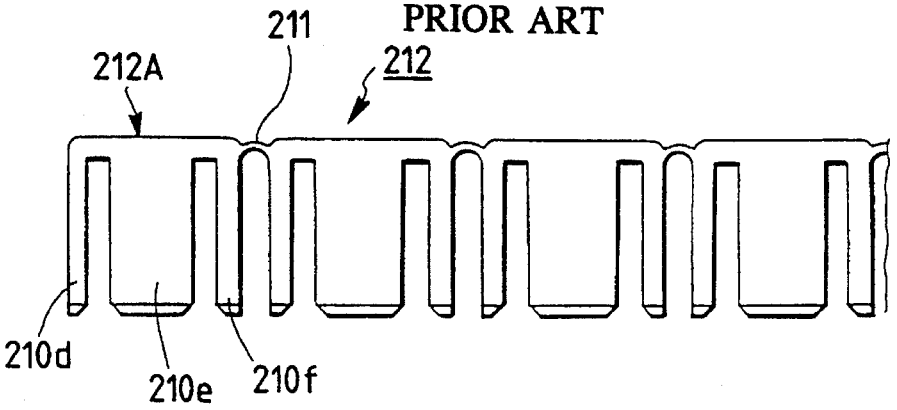
FIG. 24 PRIOR ART
FIG. 24 is a front-elevational view of the conventional retainer of the multi-interconnecting type.
Figure 22:
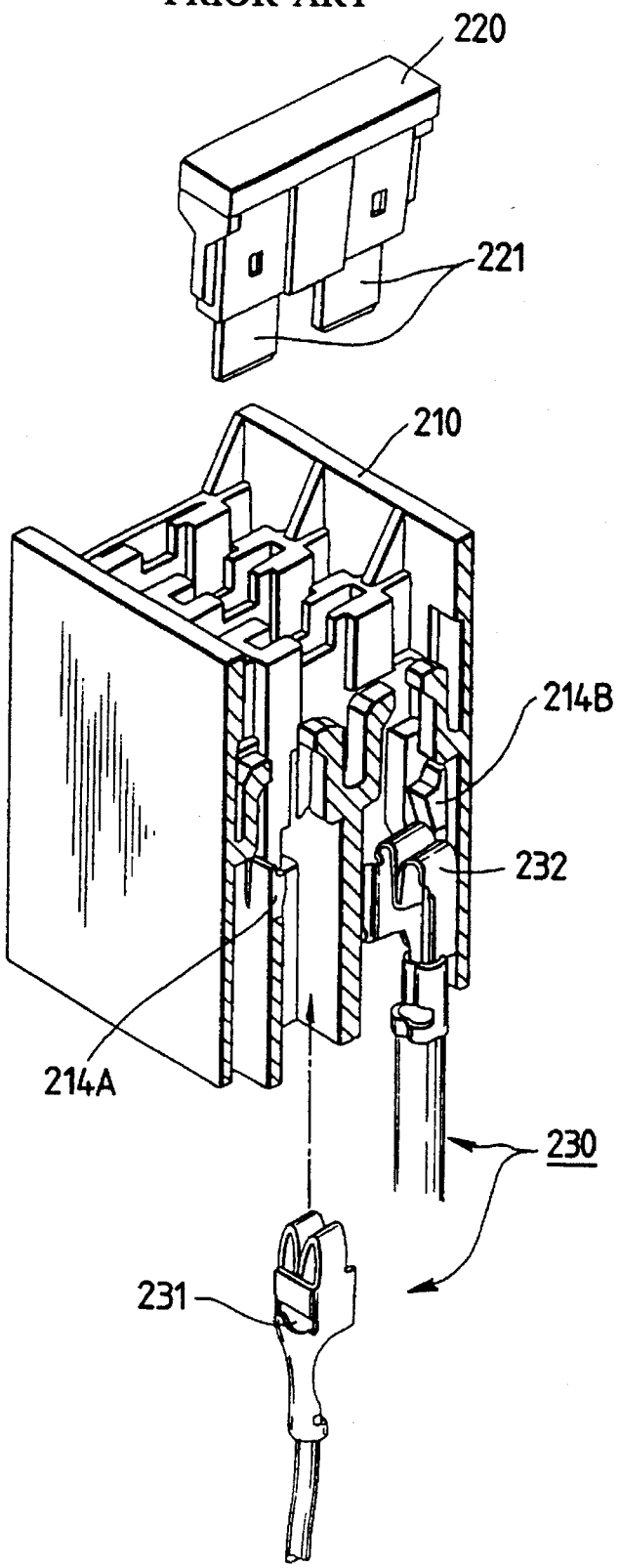
FIG. 22 PRIOR ART
FIG. 22 is a perspective view showing a conventional connector housing and a fuse element.

FIG. 21 is a perspective view of another embodiment of a retainer of the invention for a connector.

This retainer 301 is of a single interconnecting-type, and has two lock arms 302 and expanding portions 307A and 307B. Except for the single interconnecting-type, this retainer has generally the same function as the connector retainer of FIG. 16 has.

In the above embodiments, although the connector is used for the fuse, the retainer of the present invention can be used not only for the fuse connector but also for various kinds of electrical connectors.

In the above embodiments, although the paired metal terminals are used, the invention is not limited to such a paired construction, and can be applied to the type of electrical connector in which single-electrode metal terminals are arranged in a one-dimensional manner.

In the connector retainer of the present invention, a loud color can be applied to the side surface of the expanding portion, thereby facilitating the confirmation. For example, the retainer is integrally made of a yellow synthetic resin, and for example, a red color is applied only to the side surface of the yellow expanding portion. By doing so, if all of the retainers arranged in a row are in their completely-retained condition, this red color is concealed by the adjoining retainer, and therefore can not be viewed; however, if even one of them is in the provisionally-retained condition, the expanding portion of a red color is raised, and therefore the provisionally-retained condition of this retainer can be easily confirmed.

By applying a loud color to the side surface of the expanding portion, even if the connector is shipped from the factory, with all of the retainers provisionally retained, the failure in attachment of any retainer, or an incomplete attachment thereof can be easily found depending on whether or not the red color is present, and the shipping of defective products can be reduced greatly.

As described above, in the retainer for the connector of the present invention, the first lock arms and the second lock arms have generally the same length, and the retainer is generally symmetrical with respect to a line passing through the base portion thereof. Therefore, the direction of attachment of the retainer is not limited, and an assembling mistake is eliminated, and besides any special assembling control is not needed, and further there is no need to provide any erroneous connection prevention means on the connector housing or the retainer. Therefore, the cost can be reduced.

Moreover, since each pair of first and second lock arms performs the function of the conventional prevention piece, the use of the conventional prevention piece is omitted, so that the connector can be simplified in construction and be of a small size, and the cost of material as well as the cost of the mold can be reduced. This makes it possible to provide the connector at low costs.

Furthermore, since the terminal withdrawing jig can be inserted through the slit, the terminal can be withdrawn quite easily, thus markedly enhancing the efficiency of the operation.

As described above, when the retainers of the present invention are attached to the connector housing, those retainers in the provisionally-retained condition are held in a shallow position in the connector housing whereas those retainers in the completely-retained condition are held in a deep position in the connector housing. Therefore, if the retained condition of part of the retainers arranged in a row is different from that of the other retainers, the position of the expanding portion of the former retainers is different from that of the expanding portions of the latter retainers, so that the positional difference between the expanding portions occurs. As a result, the expanding portions of those retainers held in the provisionally-retained condition are projected, and these retainers can be easily confirmed, or these retainers can be easily conformed from the difference in height from the adjoining retainer.

Thus, it can be confirmed that part of the retainers attached to the housing are still in the provisionally-retained condition, and therefore the connector with such incompletely or provisionally retained retainers will not be transported, and this prevents an accident that the retainer is disengaged. And besides, in the attachment of the retainers, a failure to hold the retainer in the completely-retained position can be easily confirmed, and this avoids the situation in which the incompletely assembled connector is shipped. Therefore, the rate of defective products is reduced, and also the efficiency of the production is enhanced greatly.

What is claimed is:

1. A connector comprising:

a connector housing including:

a plurality of terminal accommodating chambers in which terminals are inserted with a space defined therebetween;

a plurality of elastic retaining pieces provided with support walls which are mounted adjacent to terminal accommodating chambers so as to retain metal terminals, respectively; and a plurality of retainer-retaining protuberances provided on said support walls adjacent the terminal receiving chambers; and a retainer including a base portion at one end thereof and a plurality of lock arms extending therefrom toward an opposite end thereof to form a comb-like structure, said retainer being retained at one of a provisionally locked position and a completely locked position by said protuberances when said retainer is inserted into said connector housing wherein in said provisionally locked position said terminals are insertable into said chambers and in said completely locked position said elastic retaining lances are prevented from being disengaged from said terminals and wherein the retainer includes an expanding portion which is formed integrally on an upper surface of said base portion of said retainer at at least one of the opposite longitudinal ends of said base portion, said expanding portion being larger in width than said base portion.

2. A connector as claimed in claim 1, wherein the retainer retaining protuberances includes provisionally retaining protuberances and completely retaining protuberances.

3. A connector as claimed in claim 1, wherein each said lock arm is received in each said space.

4. A connector as claimed in claim 1, further comprising:

indicating means for indicating a color different from a color of surrounding portions of the retainer, the color different from a color of surrounding portions is applied to a side surface of said expanding portion of said retainer.

5. A connector as claimed in claim 1, wherein the retainer is substantially symmetrical with respect to the center thereof.

* * * * *